US006447251B1

(12) United States Patent
Zeng

(10) Patent No.: US 6,447,251 B1
(45) Date of Patent: Sep. 10, 2002

(54) FAN BLADE

(75) Inventor: Ling-Zhong Zeng, Lake In The Hills, IL (US)

(73) Assignee: Revcor, Inc., Carpentersville, IL (US)

( * ) Notice: Subject to any disclaimer, the term of this patent is extended or adjusted under 35 U.S.C. 154(b) by 0 days.

(21) Appl. No.: 09/558,745

(22) Filed: Apr. 21, 2000

(51) Int. Cl.[7] ..... F04D 29/34

(52) U.S. Cl. ..... 416/210 R; 416/223 R; 416/DIG. 2; 416/DIG. 5

(58) Field of Search ..... 416/238, 210 R, 416/223 R, DIG. 2, DIG. 5

(56) References Cited

U.S. PATENT DOCUMENTS

| | | | | |
|---|---|---|---|---|
| 4,063,852 A | * | 12/1977 | O'Connor | 416/228 |
| 4,358,245 A | | 11/1982 | Gray | |
| 4,548,548 A | | 10/1985 | Gray | |
| 4,569,631 A | | 2/1986 | Gray | |
| 4,569,632 A | | 2/1986 | Gray | |
| 4,840,541 A | * | 6/1989 | Sakane et al. | 416/223 R |
| 4,900,228 A | | 2/1990 | Yapp | |
| 4,917,572 A | | 4/1990 | Van Houten | |
| 4,946,348 A | | 8/1990 | Yapp | |
| 4,971,520 A | | 11/1990 | Van Houten | |
| 5,000,660 A | | 3/1991 | Van Houten et al. | |
| 5,064,345 A | | 11/1991 | Kimball | |
| 5,151,014 A | | 9/1992 | Greenwald et al. | |
| 5,156,524 A | | 10/1992 | Forni | |
| 5,221,187 A | * | 6/1993 | Lorea et al. | 416/189 |
| 5,297,931 A | | 3/1994 | Yapp et al. | |
| 5,342,167 A | | 8/1994 | Rosseau | |
| 5,423,660 A | | 6/1995 | Sortor | |
| 5,489,186 A | | 2/1996 | Yapp et al. | |
| 5,616,004 A | * | 4/1997 | Alizadeh | 416/238 |
| 5,769,607 A | | 6/1998 | Neely et al. | |

OTHER PUBLICATIONS

"Smart' Housewares Highlights" published in *Appliance Manufacturer*, pp. 44–45, Mar. 2000.

"Advanced Technologies, Low Noise Fan, 'Extra Fan', Newly Developed", A &R News, pp. 86–87, Jan./Feb. 1986.

* cited by examiner

*Primary Examiner*—Edward K. Look
*Assistant Examiner*—James M McAleenan
(74) *Attorney, Agent, or Firm*—Michael Best & Friedrich LLP

(57) ABSTRACT

The fan blade is used for a cooling fan assembly to be coupled to the shaft of a motor for rotation about an axis. The fan blade has a curved leading edge and a curved trailing edge with an outer edge which defines an arc between a forward position and a rearward position. The fan blade leading edge is forwardly swept in the region from $0.5R_L$ to the forward position wherein $R_L$ is the length of a straight line from the axis to the forward position. The swept angle $\alpha_L$ formed by lines extending from the axis to the blade leading edge at $0.5R_L$ and to the forward position is at least 35 degrees. The camber ratio calculated by $H_L/L_L$ is larger than 0.10 but less than 0.20. The blade trailing edge is also forwardly swept in the region of $0.5R_T$ to the rearward position wherein $R_T$ is the length of a straight line from the axis to the rearward position. The swept angle $\alpha_T$ formed by lines extending from the axis to the blade trailing edge at $0.5R_T$ and to the rearward position is at least 30 degrees but less than 40 degrees. The camber ratio $H_T/L_T$ is larger than 0.10 but less than 0.20.

14 Claims, 7 Drawing Sheets

FAN BLADE

BACKGROUND OF THE INVENTION

1. Field of the Invention

The invention relates to a fan blade shaped to reduce noise during operation thereof.

2. Description of the Prior Art

A typical fan assembly for the application of condenser cooling in both residential and commercial air conditioning systems consists of a hub, a multi-wing spider, and multi blades, which could be 2, 3, or 4 blades. Each spider wing is attached with a blade through riveting or spot welding or other mechanical means. In a typical condenser cooling application, the fan is directly driven by a motor to draw airflow through the condenser coils to achieve cooling effect. The current art of condenser fan assembly implements rectangular blade shapes. These fans will generate sufficient air to meet varied cooling needs when they are pitched properly, however, they also radiate high levels of noise during operation.

In a typical condenser cooling application, the upstream air flow of a rotating fan is partially distorted due to the blockage of compressor, controlling panels, etc. As a result of it, tonal and broadband noise will be generated by a rotating blade leading edge cutting through the flow distortion, i.e. turbulence. Each small segment of the leading edge along the radial direction acts as a noise radiator.

SUMMARY OF THE INVENTION

It is an object of the invention to provide a unique and effective blade for a fan assembly which produces sufficient air for cooling purposes with low noise level.

The fan blade is formed from a flat blank bent to a desired shape to form the fan blade. The fan blade has a front side, a rear side, an inner attachment portion, an outer edge, a curved leading edge and a curved trailing edge. The outer edge defines an arc between a forward position and a rearward position. The leading edge extends outward and intercepts the arc of the outer edge at the forward position and the trailing edge extends outward to the rearward position. An angle $\alpha_L$ is formed by a straight line having a length equal to $R_L$ extending from a given axis coinciding with the axis of the fan to the forward position and a line extending from said given axis to a first position on the leading edge and having a length equal to about $0.5R_L$ wherein the angle $\alpha_L$ is equal to at least 35 degrees.

In a another aspect, the ratio of $H_L/L_L$ is larger than about 0.10 but less than about 0.20, wherein $L_L$ is the length of a straight line from the first position to the forward position and $H_L$ is the maximum distance from $L_L$ to the leading edge as measured from a straight line perpendicular to $L_L$ and extending to the leading edge.

In a further aspect the angle $\alpha_T$ is at least 30 degrees but less than 40 degrees wherein $\alpha_T$ is formed by a line having a length equal to $R_T$ extending from said given axis to the rearward position and a line extending from said given axis to a second position the trailing edge and having a length equal to about $0.5R_T$.

In addition, the ratio $H_T/L_T$ is larger than about 0.10 but less than 0.20, wherein $L_T$ is equal to the length of a straight line from the second position to the rearward position and $H_T$ is equal to the maximum distance from $L_T$ to the trailing edge as measured from a straight line perpendicular to $L_T$ and extending to the trailing edge.

DESCRIPTION OF THE PREFERRED EMBODIMENTS

Figure 1:
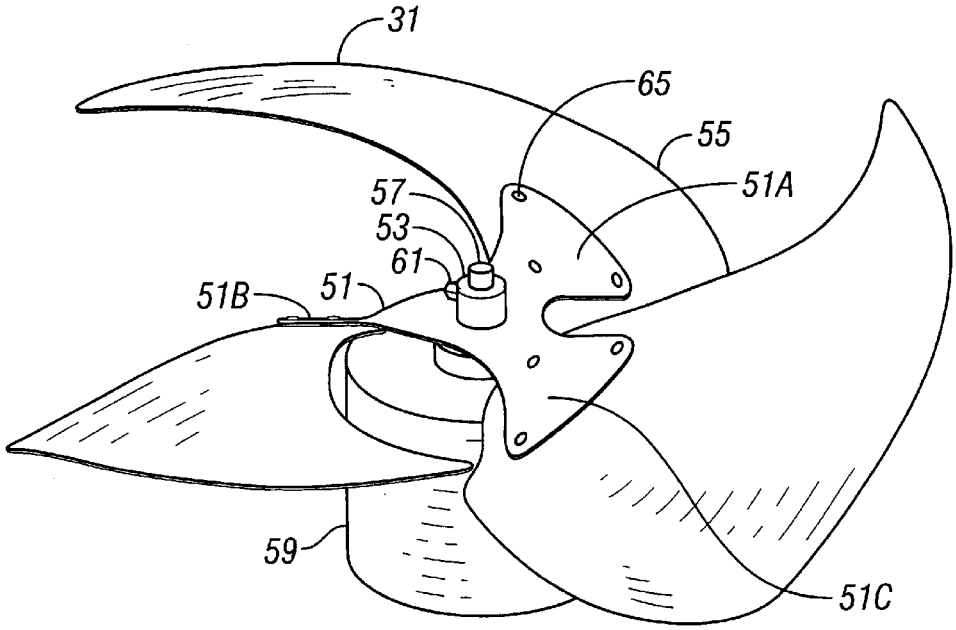
FIG. 1 is an isometric view of a fan assembly employing three blades of the invention and attached to the shaft of a motor.
Figure 2:
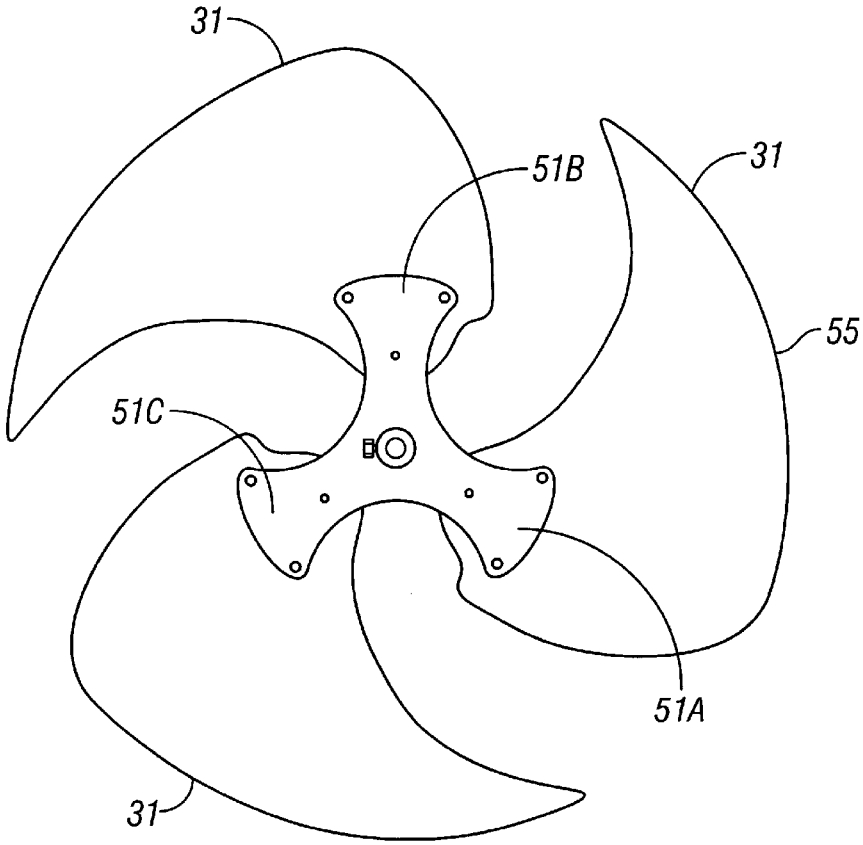
FIG. 2 is a front plan view of the fan assembly with the blades having no pitch.

Referring now to the drawings, the fan blade of the invention is identified at 31. Three of the blades 31 are shown attached to an attachment device or spider 51 which is attached to a hollow cylindrical member 53 which forms a fan assembly 55. The member 53 is fitted around and attached to the shaft 57 of an electric motor 59 by way of a threaded member 61. The fan assembly may be used for cooling a condenser. The fan assembly 55 is shown to have three identical blades 31, however, it may have for example two identical blades, three identical blades or four identical blades of different sizes.

Figure 3:
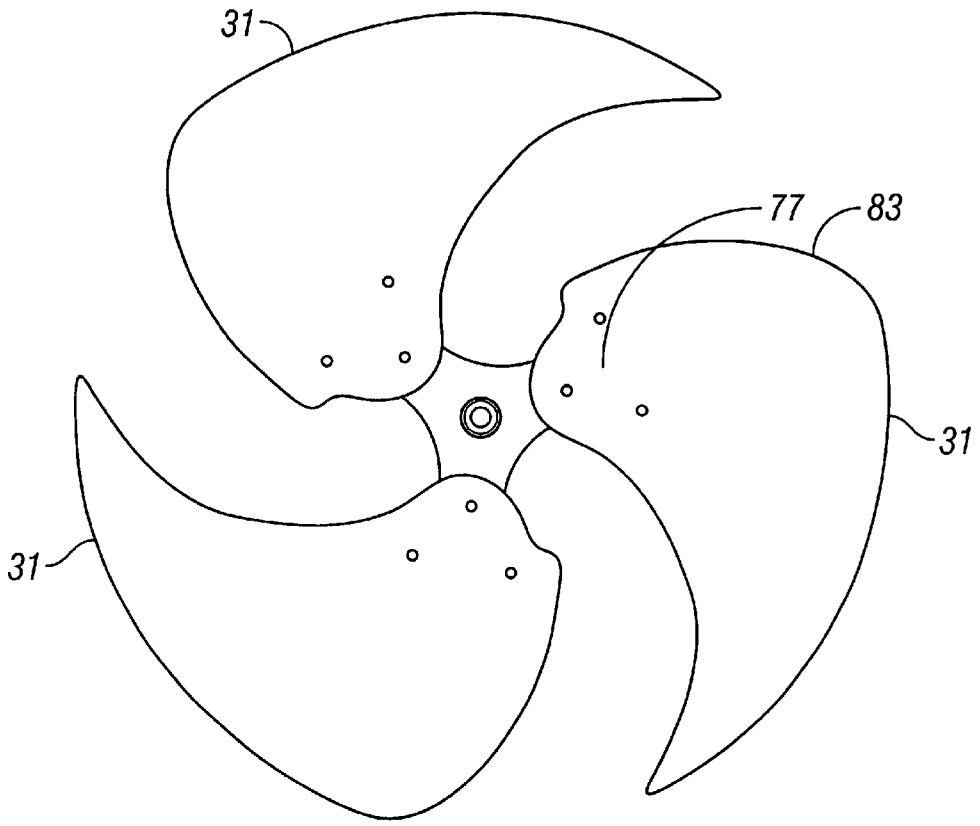
FIG. 3 is a rear plan view of the fan assembly with the blades having no pitch.
Figure 4:
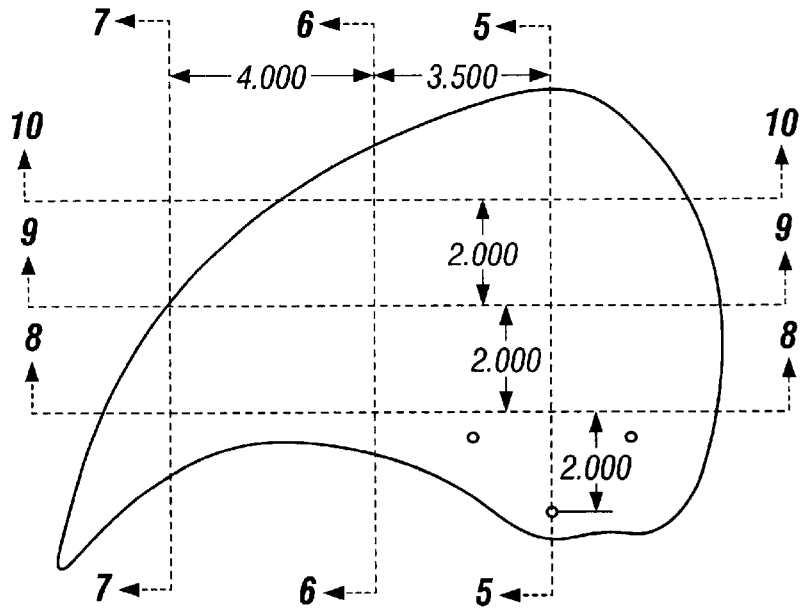
FIG. 4 is a plan view of one of the blades of FIG. 1 as seen from the front side.
Figure 5:
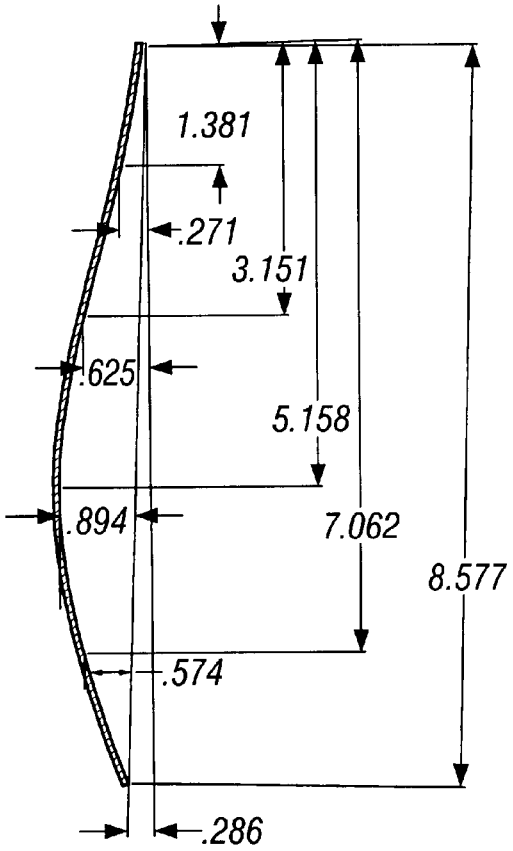
FIGS. 5, 6, and 7 are cross-sectional views of FIG. 4 as seen along lines A—A, B—B, and C—C thereof
Figure 6:
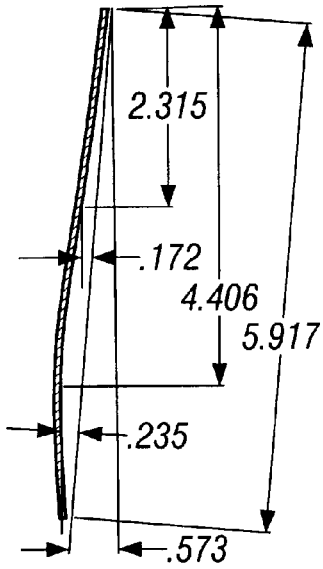
Figure 7:
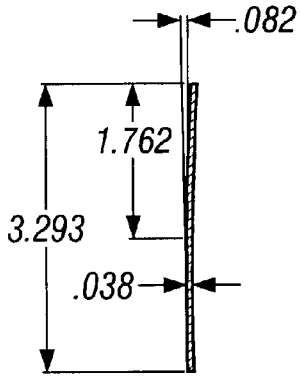
Figure 8:
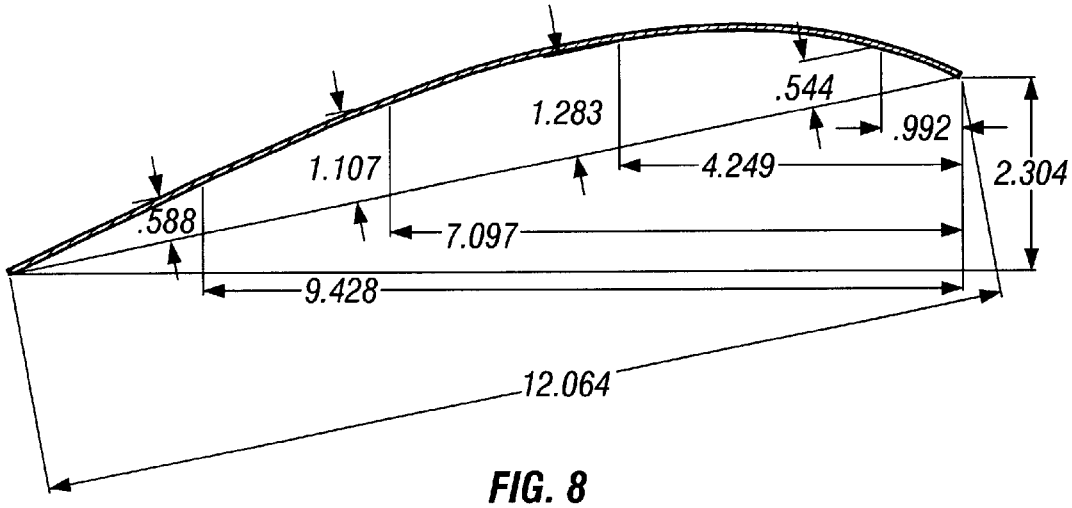
FIGS. 8, 9, and 10 are cross-sectional views of FIG. 4 as seen along lines D—D, E—E, and F—F thereof.
Figure 9:
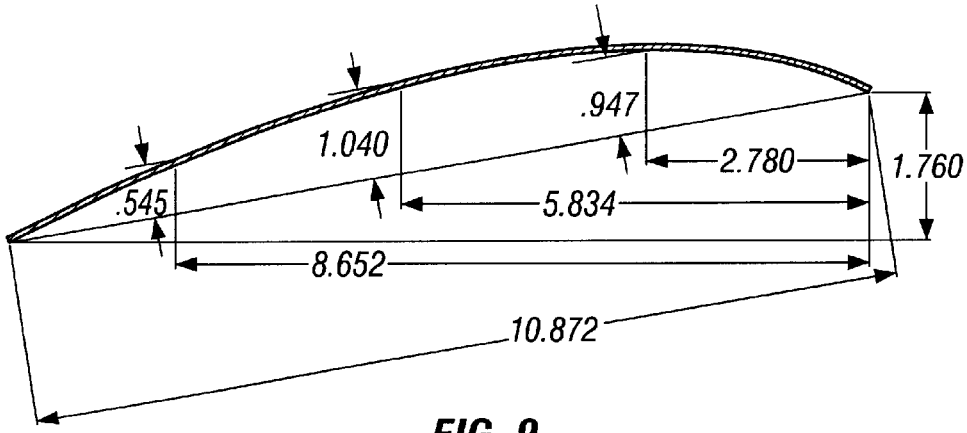
Figure 10:
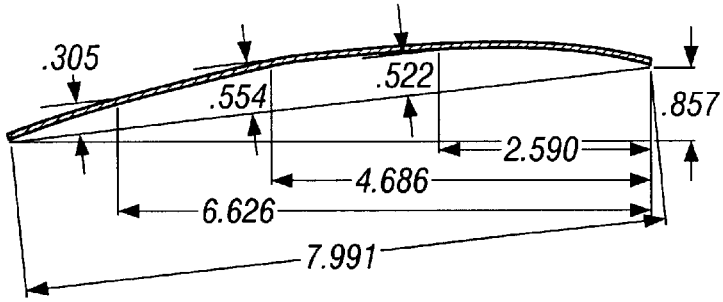
Figure 12:
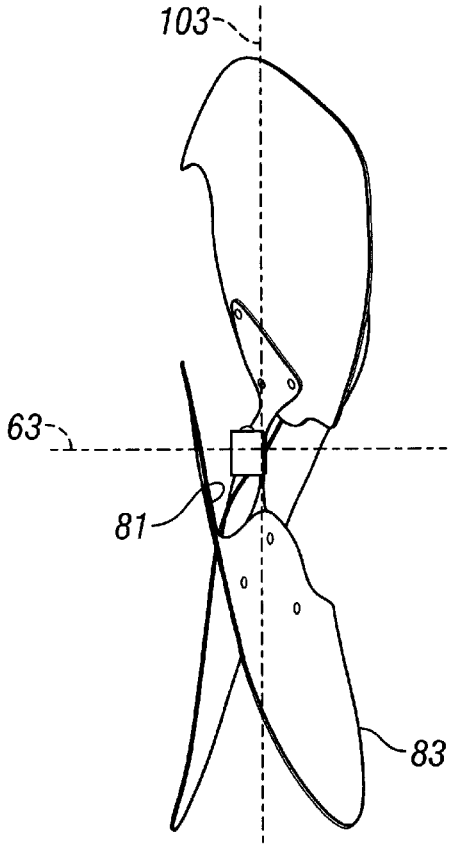
FIG. 12 is a side view of the fan assembly of FIG. 1.
Figure 13:
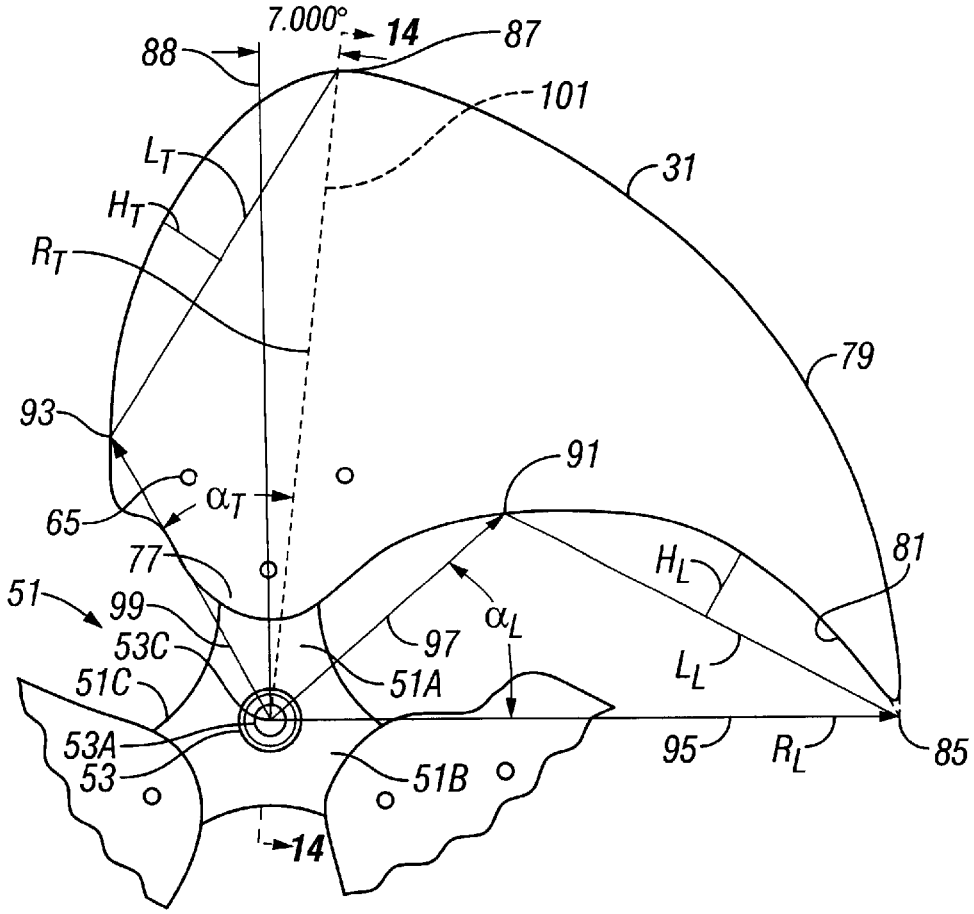
FIG. 13 is a plan view of the rear side of one of the blades attached to a spider but with zero pitch.

Each of the blades 31 is formed from a flat metal blank. The metal used may be aluminum. The blades then are bent to have a concave rear side and a convex front side. Referring to FIG. 13, the blade 31 has an inner attachment portion 77 (See FIG. 3), an outer edge 79, a curved leading edge 81 and a curved trailing edge 83. The attachment portion 77 is attached to one arm 51A of a spider 51 which is attached to cylinder 53 having a central aperture 53A with a centerpoint 53C at the axis 63 (See FIGS. 11 and 12). The arcs of the edges 79 and 81 join at a forward position at juncture 85 and edges 79 and 83 join at a rearward position at juncture 87. The outer edge 79 defines an arc from point 85 to juncture 87. The leading edge 79 is forward swept in the region between point 91($0.5R_L$) and point 85 and the trailing edge 83 is forward swept in the region between point 93($0.5R_T$) and point 87. Point 91 is referred to as a first position. The swept angle $\alpha_L$ formed by lines 95 and 97 is at least about 35 degrees. Line 95 has a length equal to $R_L$ and extends from 53C to 85 and line 97 extends from 53C to 91. The fan blade edge 81 in the region 91–85 is concave and the camber ratio calculated by $H_L/L_L$ is larger than 0.10 but less than 0.20. $L_L$ extends from 91 to 85 and $H_L$ extends from $L_L$ to edge 81. $H_L$ is perpendicular to $L_L$ and is the maximum distance from $L_L$ to edge 81.

The blade trailing edge 83 also is forwardly swept in the region 93–87. Point 93 is referred to as a second position. The swept angle $\alpha_T$ formed by lines 99 and 101 is at least about 30 degrees but less than about 40 degrees. Line 99 extends from 53C to 93 and line 101 extends from 53C to 87. Line 101 has a length equal to $R_T$, Line 88 extends radially from 53C along the midpoint of the wing 51A of the spider. The trailing edge 83 is convex with a chamber ratio $H_T/L_T$ being larger than 0.10 but less than 0.20. $L_T$ extends from 93 to 87 and $H_T$ extends from $L_T$ to 83. $H_T$ is perpendicular to $L_T$ and is the maximum distance from $L_T$ to 83. The blade 31 is bent or formed such that the surface of the rear side is concave and the surface of the front side is convex as shown in FIGS. 5–10, 12 and 14.

Figure 14:
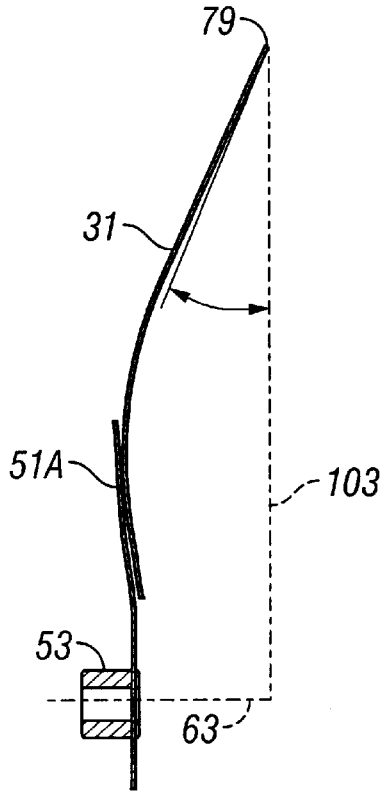
FIG. 14 is a cross sectional view of FIG. 13 as seen along lines M—M.

Referring to FIG. 14, line 103 is perpendicular to the axis 63 and extends radially outward from the axis in the plane of the line 101 of FIG. 13 to the outer edge 79. The angle β should be at least 10 degrees.

Figure 11:
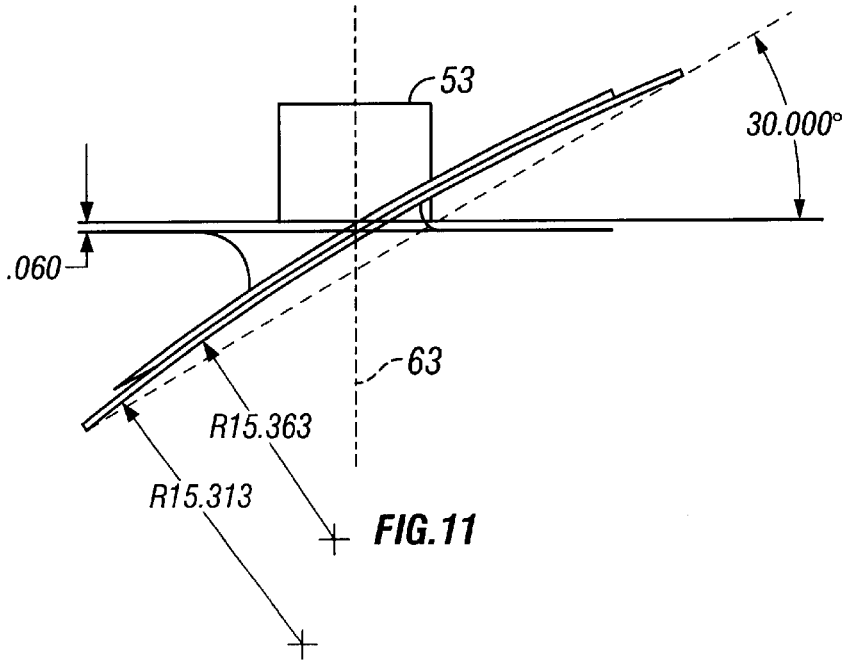
FIG. 11 illustrates the pitch or angle of attachment of one of the blades to the shaft of the motor.

The spider 51 has three arms or wings, 51A, 51B, and 51C each of which extend outward at a given pitch angle relative to the axis 63 of the member 53 as shown in FIG. 11. The pitch angle may vary. Each of the blades 31 is attached to one of the spider arms 51A, 51B, 51C by bolts 65. In FIG. 13, the arms 51C and 51B are not completely shown. Adjacent arms and hence adjacent blades are angularly spaced apart 120 degrees. As shown in FIG. 12, the leading edge 81 of each blade is forward of a plane 103 perpendicular to the axis 63 and the trailing edge 83 of each of the blades is rearward of the plane 103.

The leading edge swept as described above will vary the timing of varied segments of the leading edge to cut through fixed-position turbulence and therefore vary the phase of the noise radiated. This special leading edge arrangement assures that the acoustic energy can be canceled from a maximum level due to phase differences, compared with straight leading edges or other designs.

Figure 16:
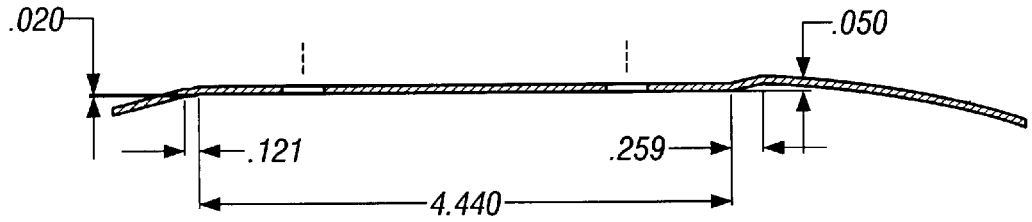
FIG. 16 is a cross-section of FIG. 15 taken along the lines N—N thereof.
Figure 15:
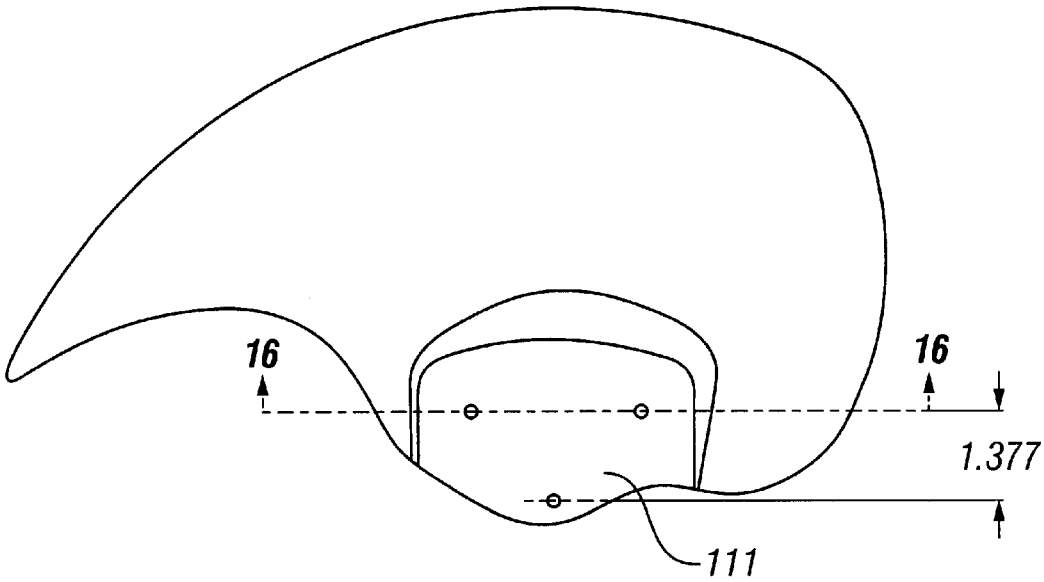
FIG. 15 is a plan view of the front side of another fan blade which has a flat mounting pad.

The blade of FIGS. 15 and 16 is the same as the blade of FIGS. 4–10 and 13 but has a flat mounting portion or pad 111.

Boundary layers are formed along the suction face of the rotating blade and become turbulent near the trailing edge due to the positive pressure gradient. This turbulence is also a major noise contributor and can be reduced by a well swept-trailing edge. The natural path of the air stream, along which a boundary layer is formed, goes from the leading edge to the trailing edge and slightly outward to the tip due to centrifugal effect. The trailing edge as described above will allow a relatively short air path to reduce boundary layer separation, or turbulence, to reduce noise while maintaining sufficient blade chord length to achieve air performance and efficiency.

The curvature in the blade chord is common for most of the fans and is necessary for good performance. However, the curvature along a radial direction adapted in this blade is unique. This curvature will allow the blade to suck air from the tip to increase air flow and reduce the turbulence in the tip region to reduce noise.

In one embodiment, each blade 31 may have the dimensions in inches as shown in FIGS. 4–11, 15, and 16 although these dimensions will vary depending on the size of the blade.

What is claimed is:

1. A blade for use in a fan assembly to be coupled to the shaft of a motor for rotation about an axis, said blade comprising:

a front side, a rear side, an inner attachment portion, a curved outer edge, a curved leading edge, and a curved trailing edge, said blade having a convex front side and a concave rear side, said outer edge defining an arc extending between a forward position and a rearward position, said leading edge extends outward and intersects the arc of said outer edge at said forward position, said trailing edge extends outward to said rearward position, said blade comprises an angle $\alpha_L$ formed by a straight line having a length equal to $R_L$ extending from a given axis coinciding with the axis of the fan assembly to said forward position and a straight line extending from said given axis to a first position on said leading edge and having a length equal to about $0.5R_L$ wherein said angle $\alpha_L$ is equal to at least 35 degrees.

2. The blade of claim 1, wherein:

said rear side of said blade is concave and in a plane extending radially from said given axis to said outer edge, the outer portion of said blade defines an angle of at least 10 degrees relative to a straight line perpendicular to said given axis and extending from said given axis to said outer edge.

3. The blade of claim 1, wherein:

the ratio of $H_L/L_L$ is larger than about 0.10 but less than about 0.20, wherein $L_L$ is the length of a straight line from said first position to said forward position and $H_L$ is equal to the maximum distance from $L_L$ to said leading edge as measured from a straight line perpendicular to $L_L$ and extending to said leading edge.

4. The blade of claim 3, wherein:

the angle $\alpha_T$ formed by a line having a length equal to $R_T$ extending from said given axis to said rearward position and a line extending from said given axis to a second position on said trailing edge and having a length equal to about $0.5R_T$, is equal to at least 30 degrees but less than 40 degrees.

5. The blade of claim 4, wherein:

the ratio $H_T/L_T$ is larger than about 0.10 but less than about 0.20, wherein $L_T$ is equal to the length of a straight line from said second position to said rearward position and $H_T$ is equal to the maximum distance from $L_T$ to said trailing edge as measured from a straight line perpendicular to $L_T$ and extending to said trailing edge.

6. The blade of claim 5, wherein:

said rear side of said blade is concave and in a plane extending radially from said given axis to said outer edge, the outer portion of said blade defines an angle of at least 10 degrees relative to a straight line perpendicular to said given axis and extending from said given axis to said outer edge.

7. The blade of claim 5, wherein:

a plurality of said blades are attached to an attachment means to form a fan assembly with said front side of each of said blades facing forward and the rear side of each of said blades facing rearward, said attachment means has a central aperture having an axis coinciding with said given axis for attachment to a shaft of a motor with adjacent blades being radially spaced apart at a given angle.

8. The blade of claim 1, wherein:

the projection of said outer edge and said leading edge join each other at said forward position.

9. The blade of claim 1, wherein:

a plane formed by the projection of said straight line extending from said given axis to said first position on said leading edge and which plane extends along and radially outward from said given axis is spaced from said blade between said given axis and said first position.

10. A fan assembly comprising, a blade attachment means having a central aperture with an axis for receiving a shaft of a motor for rotating said fan assembly, a blade attached to said blade attachment means, said blade comprising:

a front side, a rear side, an inner attachment portion, a curved outer edge, a curved leading edge, and a curved tailing edge, said outer edge defining an arc extending between a forward position and a rearward position, said leading edge extends outward and intersects the arc defined by said outer edge at said forward position, said trailing edge extends outward to said rearward position, said blade comprises an angle $\alpha_L$ formed by a straight line having a length equal to $R_L$ extending from said axis to said forward position and a line extending from said axis to a first position on said leading edge and having a length equal to about $0.5R_L$ wherein said angle $\alpha_L$ is equal to at least 35 degrees.

11. The fan assembly of claim 10, wherein:

the angle $\alpha_T$ formed by a line having a length equal to $R_T$ extending from said axis to said rearward position and a line extending from said axis to a second position on said trailing edge and having a length equal to about $0.5R_T$ is equal to at least 30 degrees but less than 40 degrees.

12. The fan assembly of claim 10, wherein:

the projection of said outer edge and said leading edge join each other at said forward position.

13. The fan assembly of claim 10, wherein:

a plane formed by the projection of said straight line extending from said axis to said first position on said leading edge and which plane extends along and radially outward from said axis is spaced from said blade between said axis and said first position.

14. The fan assembly of claim 11, wherein a plane formed by the projection of said straight line extending from said axis to said first position on said leading edge and which plane extends along and radially outward from said axis is spaced from said blade between said axis and said first position.

* * * * *